US006547605B2

(12) United States Patent
Daugherty et al.

(10) Patent No.: US 6,547,605 B2
(45) Date of Patent: Apr. 15, 2003

(54) FLEX CIRCUIT ELECTRICAL CONNECTOR

(75) Inventors: James D. Daugherty, Brookfield, OH (US); Kevin P. Phillips, Richardson, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/910,098

(22) Filed: Jul. 20, 2001

(65) Prior Publication Data

US 2003/0017749 A1 Jan. 23, 2003

(51) Int. Cl.[7] ..... H01R 13/00
(52) U.S. Cl. ..... 439/686; 439/701
(58) Field of Search ..... 439/686–695, 439/492, 494, 499, 701, 402, 403, 406

(56) References Cited

U.S. PATENT DOCUMENTS

| | | | | | |
|---|---|---|---|---|---|
| 3,149,897 | A | * | 9/1964 | Martineck | 439/494 |
| 3,550,066 | A | * | 12/1970 | Cootes | 439/494 |
| 3,713,073 | A | * | 1/1973 | Narozny | 439/456 |
| 3,721,941 | A | * | 3/1973 | Wisser | 439/941 |
| 3,854,790 | A | * | 12/1974 | Provinsky | 439/460 |
| 3,873,172 | A | * | 3/1975 | Paullus | 439/498 |
| 4,143,935 | A | * | 3/1979 | Goodman et al. | 439/405 |
| 4,354,719 | A | * | 10/1982 | Weidler | 439/598 |
| 4,629,279 | A | * | 12/1986 | Nishikawa | 439/404 |
| 4,772,234 | A | * | 9/1988 | Cooper | 439/851 |
| 4,923,408 | A | * | 5/1990 | Zinn | 439/341 |
| 4,927,388 | A | * | 5/1990 | Gutter | 439/660 |
| 4,964,817 | A | * | 10/1990 | Kanai | 439/686 |
| 5,026,304 | A | * | 6/1991 | Furrow | 439/595 |
| 5,613,882 | A | * | 3/1997 | Hnatuck | 439/686 |
| 5,785,558 | A | * | 7/1998 | Post et al. | 439/680 |
| 5,855,493 | A | * | 1/1999 | Shelly | 439/465 |
| 5,997,359 | A | * | 12/1999 | Picaud et al. | 439/686 |
| 6,007,367 | A | * | 12/1999 | Gehbauer | 439/402 |
| 6,012,942 | A | * | 1/2000 | Volstorf | 439/397 |
| 6,027,378 | A | * | 2/2000 | Abe et al. | 439/701 |
| 6,030,256 | A | * | 2/2000 | Capper | 439/598 |
| 6,036,550 | A | * | 3/2000 | Naganawa | 439/701 |
| 6,093,061 | A | * | 7/2000 | Varsik et al. | 439/701 |
| 6,102,728 | A | * | 8/2000 | Shinchi | 439/397 |
| 6,383,033 | B1 | * | 5/2002 | Politsky et al. | 439/686 |

* cited by examiner

*Primary Examiner*—Tho D. Ta
*Assistant Examiner*—Larisa Tsukerman
(74) *Attorney, Agent, or Firm*—Thomas N. Twomey

(57) ABSTRACT

An electrical connector uses a single flex circuit having two banks of electrical conductors each engaged to a series of terminals disposed or engaged in first and second carriers. The carriers are stacked upon one another and then inserted into a shroud of the electrical connector from a lateral direction. A clip retainer is then inserted from the rear into the shroud of the electrical connector between the first and second carriers to assure the position of the individual terminals within the respective carriers. The single flex circuit is replaced by a plurality of individual electrically insulated conductors in a second embodiment.

15 Claims, 5 Drawing Sheets

FLEX CIRCUIT ELECTRICAL CONNECTOR

TECHNICAL FIELD OF THE INVENTION

This invention relates to an electrical connector, and more specifically to a flex circuit electrical connector.

BACKGROUND OF THE INVENTION

Electrical connectors often have multiple terminals encased within an electrical connector housing or shroud. These terminals are individually crimped to multiple insulated conductors to complete the electrical circuit. Flex circuits or flat electrical conductors arranged along a single sheet of insulating substrate are also known within the art. Terminals are also known to be crimped at the end of the substrate individually engaging each individual conductor. After crimping, these terminals are then placed and locked within the core or housing of an electrical connector. The automation process of assembling an electrical connector which utilizes a flex circuit is limited. Furthermore, forming multiple rows of terminals from a single flex circuit within an electrical connector to establish a desired array or shape is also limited.

SUMMARY OF THE INVENTION

This invention provides a multi conductor electrical connector having two stacked carriers each having an inner face defining a series of grooves which individual house a plurality of terminals configured in rows. The conductor ends of a multi-conductor cable or flex circuit are preferably sonic welded to the rearward ends of the pre-mounted terminals within the carriers. The stacked carriers are inserted through a side clearance of a rearward clip portion of a shroud from a lateral direction and snap fitted therein. Once in the shroud, the opposite ends of the terminals are exposed through a forward opening defined by a forward annular portion of the shroud. Preferably, the electrical connector has a retaining clip which snap fits to, and between, the carriers and engages the terminals, preventing rearward movement of the terminals within the carriers when the terminals engage a mating connector. Longitudinally, extending within each groove is a flex arm which locks the terminals in place.

A feature of the present invention is the ability to engage or sonic weld the conductors of a flex circuit after the terminals are arranged within the carriers, thereby enhancing the manufacturing process. Another feature of the present invention is proving an electrical connector having two rows of terminals engaged to a single flex circuit.

BRIEF DESCRIPTION OF THE DRAWINGS

The presently preferred embodiments of the invention are disclosed in the following description and accompanying drawings wherein.

DETAILED DESCRIPTION OF THE PREFERRED EMBODIMENTS

Figure 1:
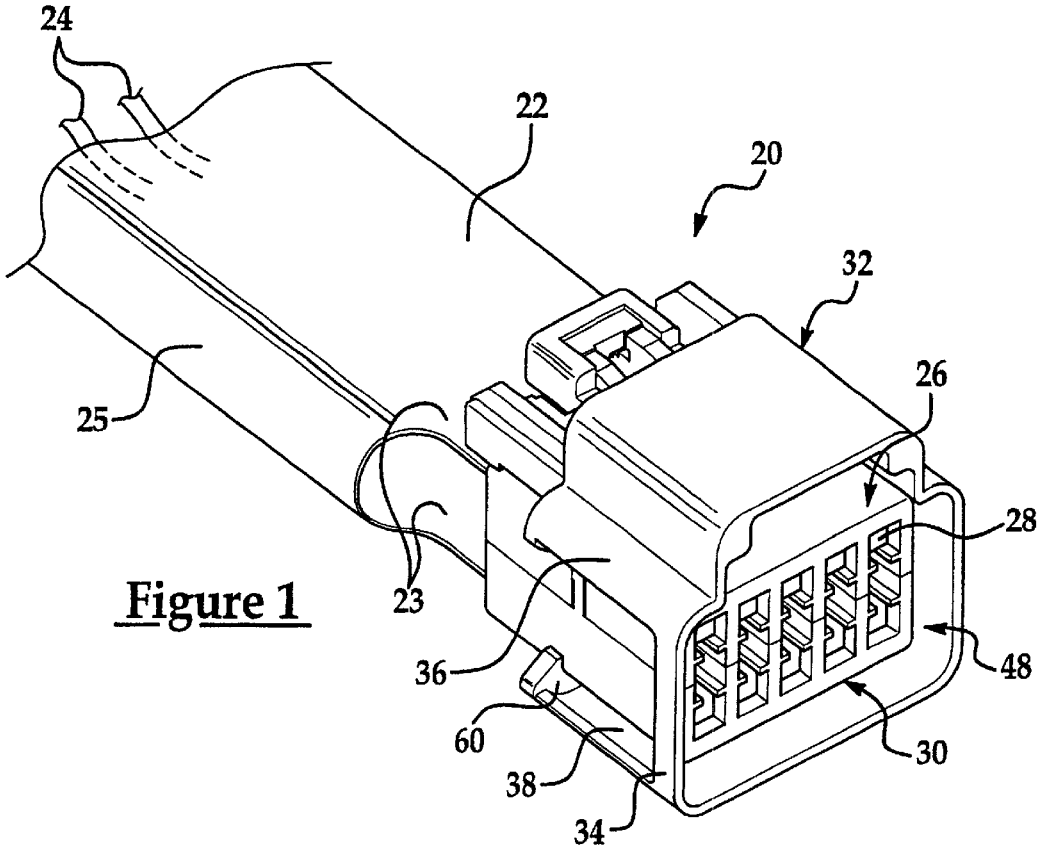
FIG. 1 is a perspective view of an electrical connector of the present invention.
Figure 2:
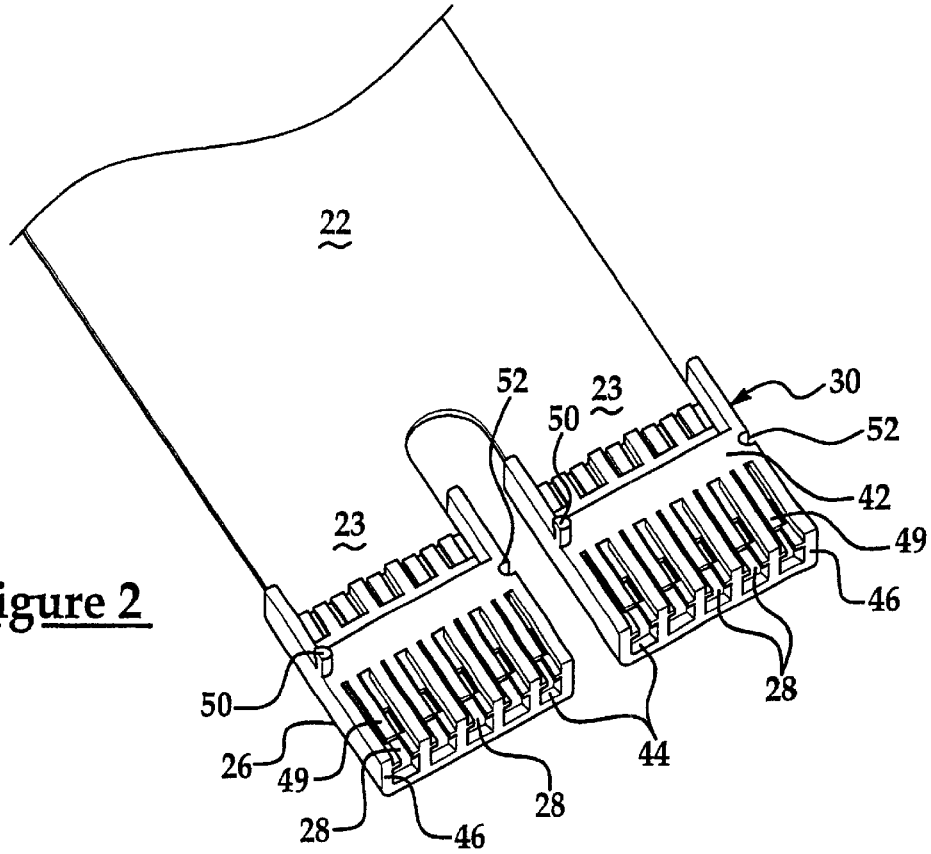
FIG. 2 is a perspective view of a first and second carrier engaged to a flex circuit.
Figure 3:
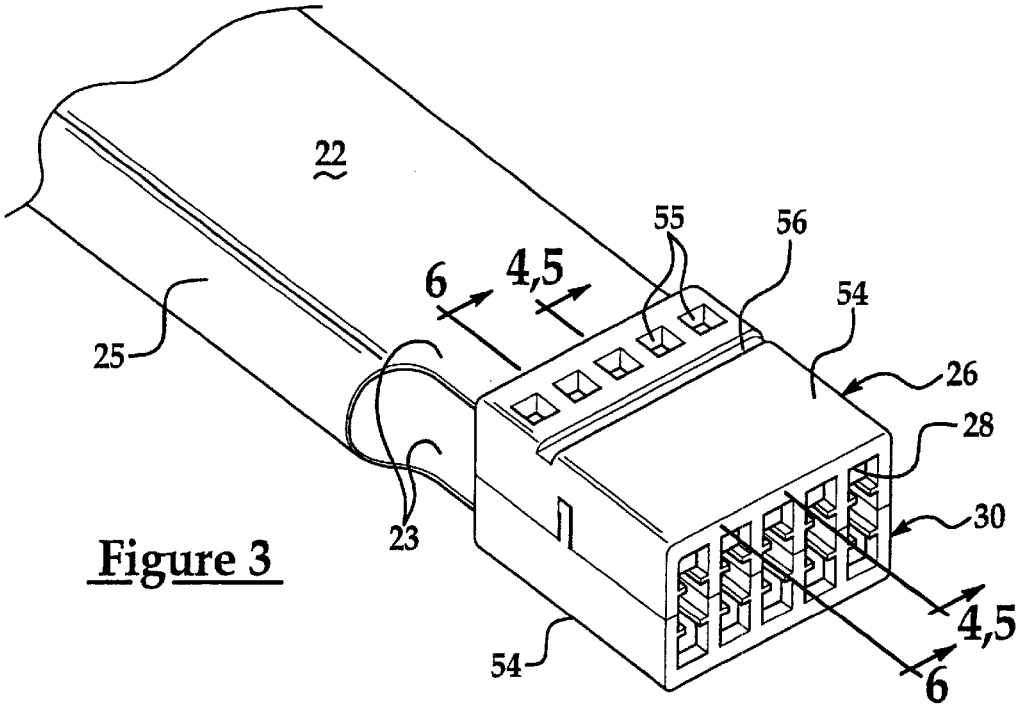
FIG. 3 is a perspective view of the first and second carriers engaged to the flex circuit when folded over upon one another.

Referring to FIGS. 1–3, an electrical connector 20 is shown having a flat multi-conductor substrate or flex circuit 22 with two banks 23 of conductors 24. A series of terminals 28 are positioned within a first insulating carrier 26, then sonic welded to the ends of each respective individual conductor 24 of the first bank 23 of the flex circuit 22. Likewise, a second carrier 30 houses a series of terminals 28 engaged to the ends of the conductors 24 of the second bank 23 of the same flex circuit 22. The flex circuit 22 folds over forming a longitudinally extending return bend 25 stacking the first bank 23 with the second bank 23. Consequently, the terminals 28 are configured in two stacked rows and, likewise, the first carrier 26 is stacked to the second carrier 30. The flex circuit 22 is made substantially of an electrical insulating substrate material and the return bend 25 is generally free of metallic conductor strips.

Figure 5:
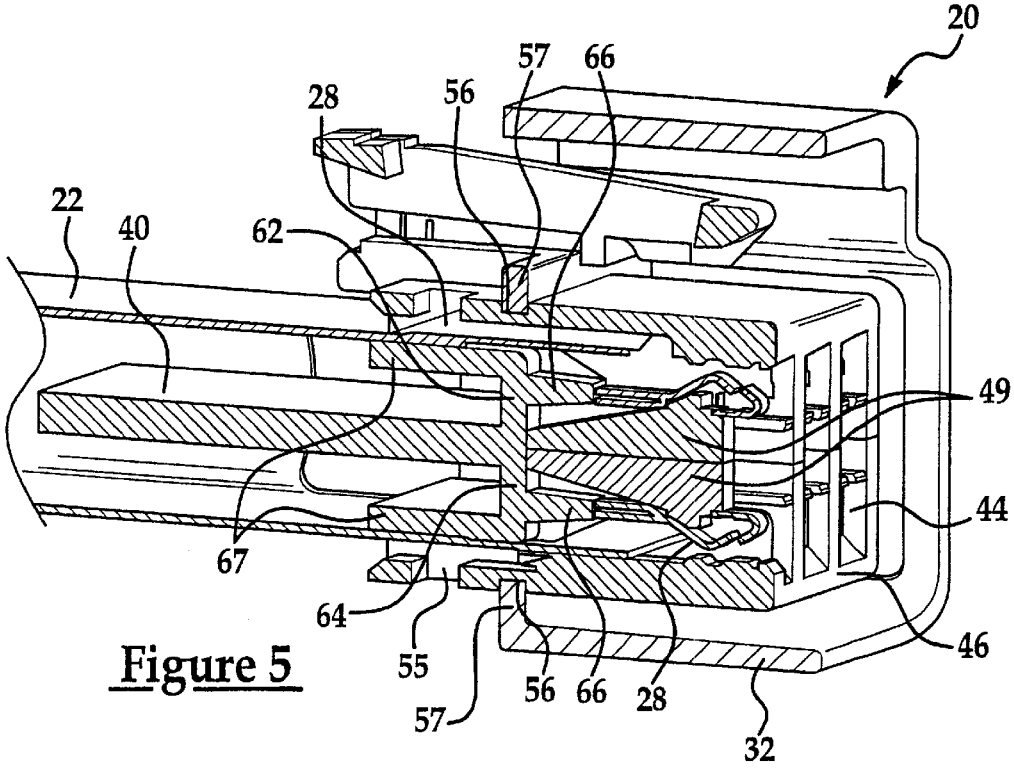
FIG. 5 is a partial perspective cross sectional view of the electrical connector taken along line 5—5 of FIG. 3 viewing in the direction of the arrows.
Figure 4:
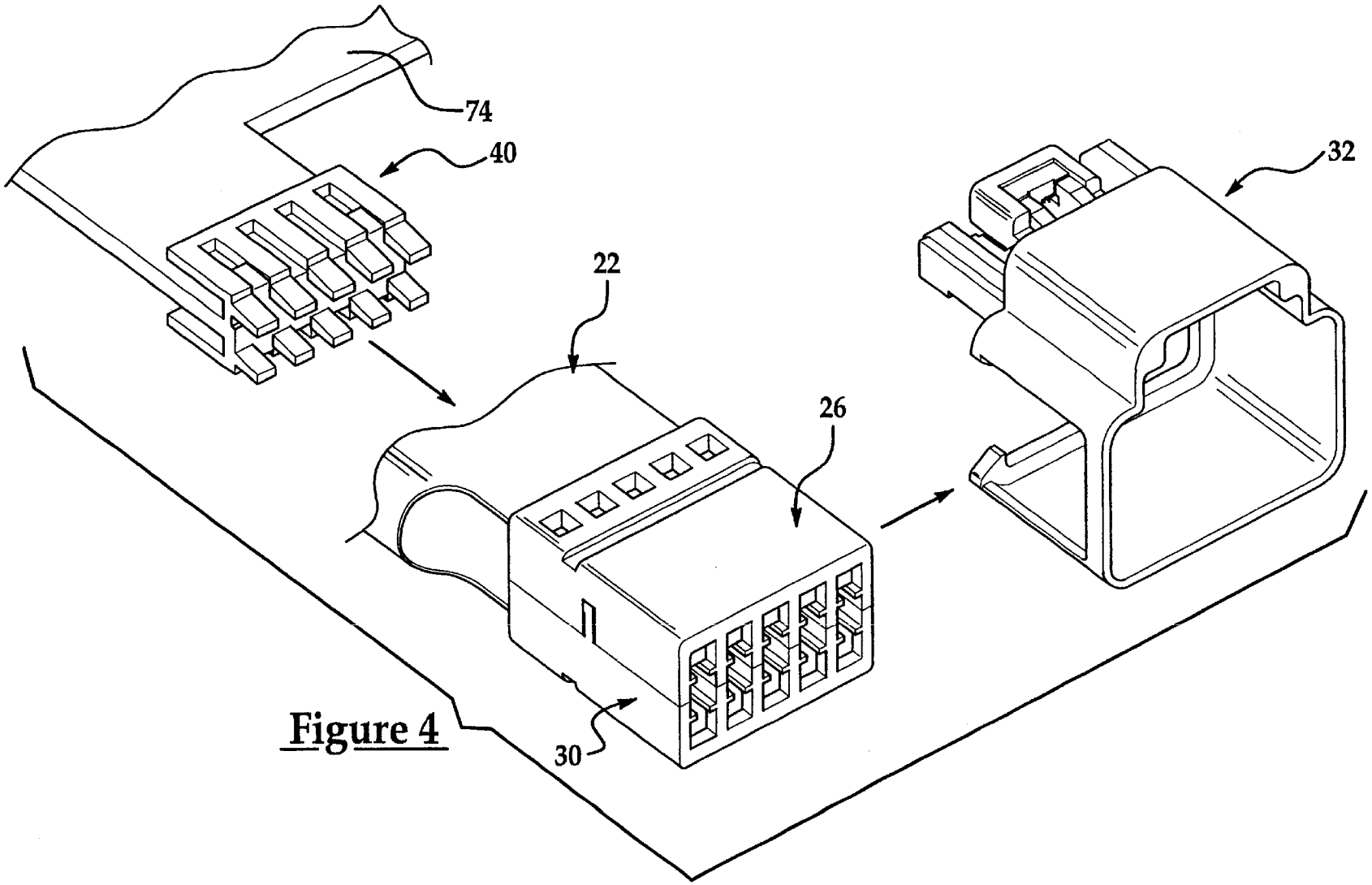
FIG. 4 is an exploded perspective view of the electrical connector.

With the first carrier 26 engaged to the second carrier 30 in a stacked formation, the carriers are simultaneously inserted laterally into a shroud 32. The shroud 32 has a forward annular portion 34 defining a forward opening 48 through which the terminals 28 are exposed for the purpose of electrical engagement to a mating connector, not shown. Shroud 32 has a rearward clip portion 36 defining a side clearance 38 through which the stacked first and second carriers 26, 30 pass laterally, during assembly as best shown in FIGS. 4 and 5. A retaining clip 40 inserts into the rearward clip portion 36 between the first and second carriers 26, 30 from behind to assure the terminals 28 are properly positioned within the carriers 26, 30. The shroud and the carriers are made of an electrical insulating material such as, and preferably, plastic.

Referring to FIGS. 2–4, the first and second carriers 26, 30 are identical to minimize manufacturing costs. Each carrier has an inner face 42 which defines a series of elongated grooves 44 wherein the terminals 28 reside. The grooves 44 extend through a forward face 46. Face 46 is exposed through the forward opening 48 of the shroud 32 when the electrical connector 20 is assembled. Extending longitudinally forward within each groove 44 is a cantilevered locking arm 49 which flexes to accept the terminal 28 within the groove 44, and returns to lock the terminal 28 in place. In assembly, the terminal 28 is engaged to an inner surface of the flex arm 49. An opposite outer surface of the arms 49 are flush with the inner face 42 of each carrier 26, 30. The outer surface of the arms 49 of the first carrier 26 engages the outer surface of the arms 49 of the second carrier 30 when the carriers are stacked thereby preventing any further flexing of the arms and locking the terminals 28 in place. Projecting rigidly from the inner face 42 of each carrier 26, 30 is a post 50 which is disposed substantially near a side edge of the carrier. A post hole 52 is located along the opposite edge of each carrier 26, 30. The posts 50 and the holes 52 are fully mated when the inner face 42 of the first carrier 26 is in contact with the inner face 42 of the second carrier 30, thereby aligning and preventing the carriers from sliding in relation to one-another.

Both carriers 26, 30 have an opposite or outer face 54. A series of sonic welding access ports 55 extend through the outer face 54 of the carrier and communicate with each respective groove 44 defined by the inner face 42. During assembly, the flex circuit 22 and the terminals 28 are orientated between a first and second member of a sonic welding assembly tool. The first member inserts through each port 55, and the second member of the tool contacts the flex circuit 22 from the opposite side, enabling the tool to weld the conductors of the flex circuit 22 to the terminals 28. After welding, the carrier 26 is stacked, or folded over, upon the carrier 30. A variety of other means, such as laser welding or gluing, may also be used to engage the terminals 28 to the conductors of the circuit 22

After the sonic welding is complete, the stacked carriers 26, 30 are inserted laterally and snap locked into the shroud 32. To align and lock-fit the carriers 26, 30 properly within the shroud 32, the outer face 54 of each carrier defines a laterally extending slot 56 which receives a respective ledge 57 projecting radially inward from a back most perimeter of the rearward clip portion 36 of the shroud 32. The two ledges 57 are parallel and project in opposition to one-another. Each ledge has a ramped prong 60 projecting radially inward from the respective ledge 57, both disposed at the exposed end of each ledge 57 near the side clearance 38. During assembly, as the stacked carriers 26, 30 are laterally inserted through the side clearance 38, the slots 56 receive the respective prongs 60 which are temporarily pried outward and away from each other achieved by the ramp feature on each prong as it makes contact with the respective carrier 26, 30. When the carriers 26, 30 are fully inserted into the shroud 32 the prongs 60 snap fit past the trailing edges or sides of the respective carriers 26, 30 locking the carriers within the shroud 32.

Figure 7:
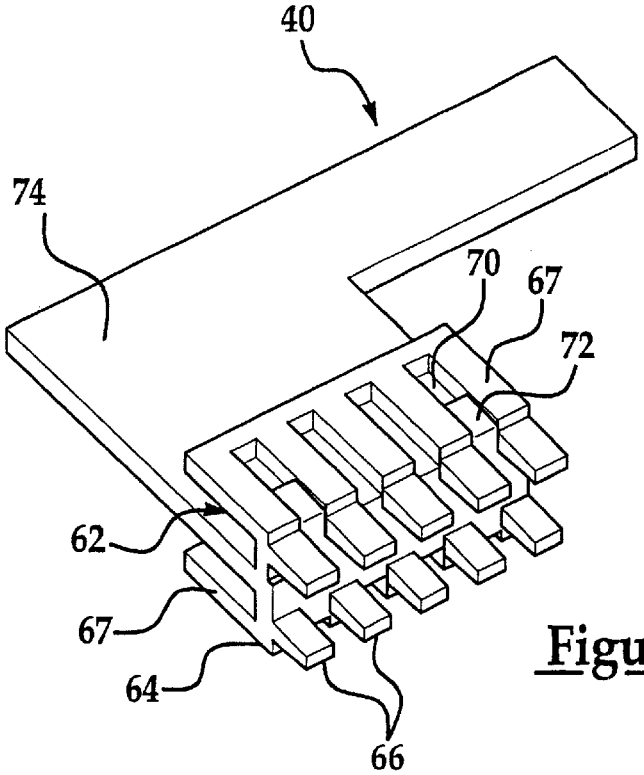
FIG. 7 is a perspective view of a retaining clip of the electrical connector.

Referring to FIGS. 5 and 7, the retaining clip 40 and snaps locks into the carriers 26, 30. Clip 40 has a leading upper return bend 62 and an opposite leading lower return bend 64, each bend having a row of forward projecting tangs 66 which engage a rearward facing portion of the terminals 28 within each respective groove 44 of the carriers 26, 30. In the present embodiment, each carrier 26, 30 is associated with five terminals 28, therefore, the upper and lower return bends 62, 64 each have five tangs 66. The upper return bend 62 has a rearward extending wing 67 which is planar and parallel to an identical rearward extending wing 67 of the lower return bend 64.

Figure 6:
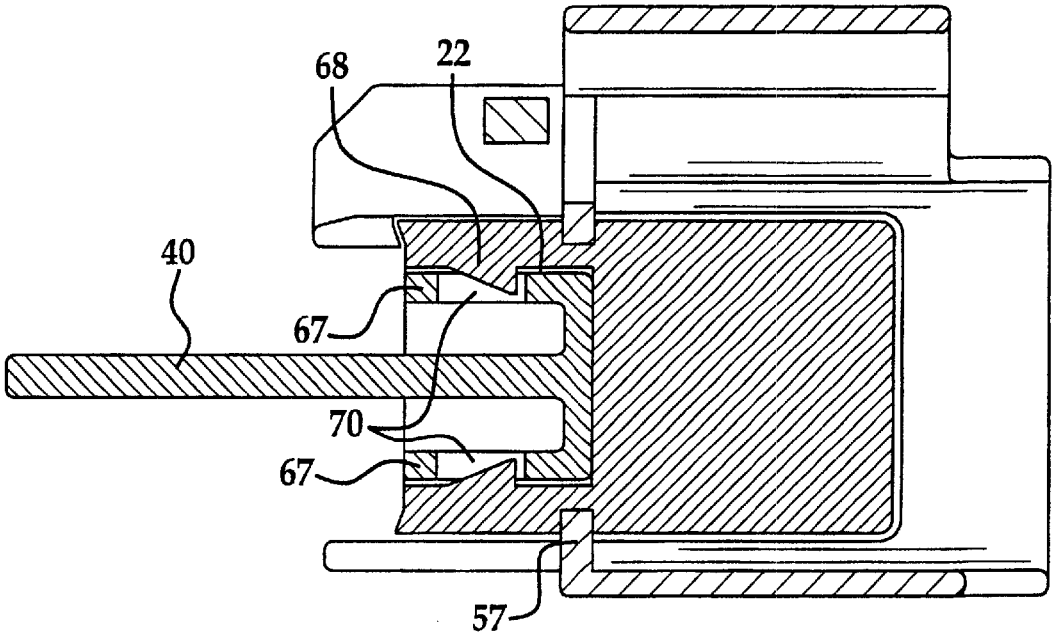
FIG. 6 a cross section view of the electrical connector taken along line 6—6 of FIG. 3 viewing in the direction of the arrows.

Referring to FIGS. 6 and 7, each carrier 26, 30 has at least one ramped projection 68 extending radially inward from the inner face 22 just forward of and between the ports 55. When the retaining clip 40 inserts into the assembled connector 20 from the rear, the projections 68 cause the wings 67 to flex inward until the projections snap into respective apertures 70 which extend through each wing. To assist this snap fit, each wing 67 has a ramped surface 72 associated with each aperture 70 and which slopes radially outward in the rearward direction and up to the respective aperture 70. When assembled, the wings 67 are engaged between the carriers 26, 30 and a planar tab portion 74 of the clip 40 projects outward therefrom, between the wings 67 acting as a strain relief and routing feature for the flex circuit 22. Furthermore, the tab portion 74 provides a means to grip the retaining clip 40 during insertion into or disassembly of the electrical connector 20.

Figure 8:
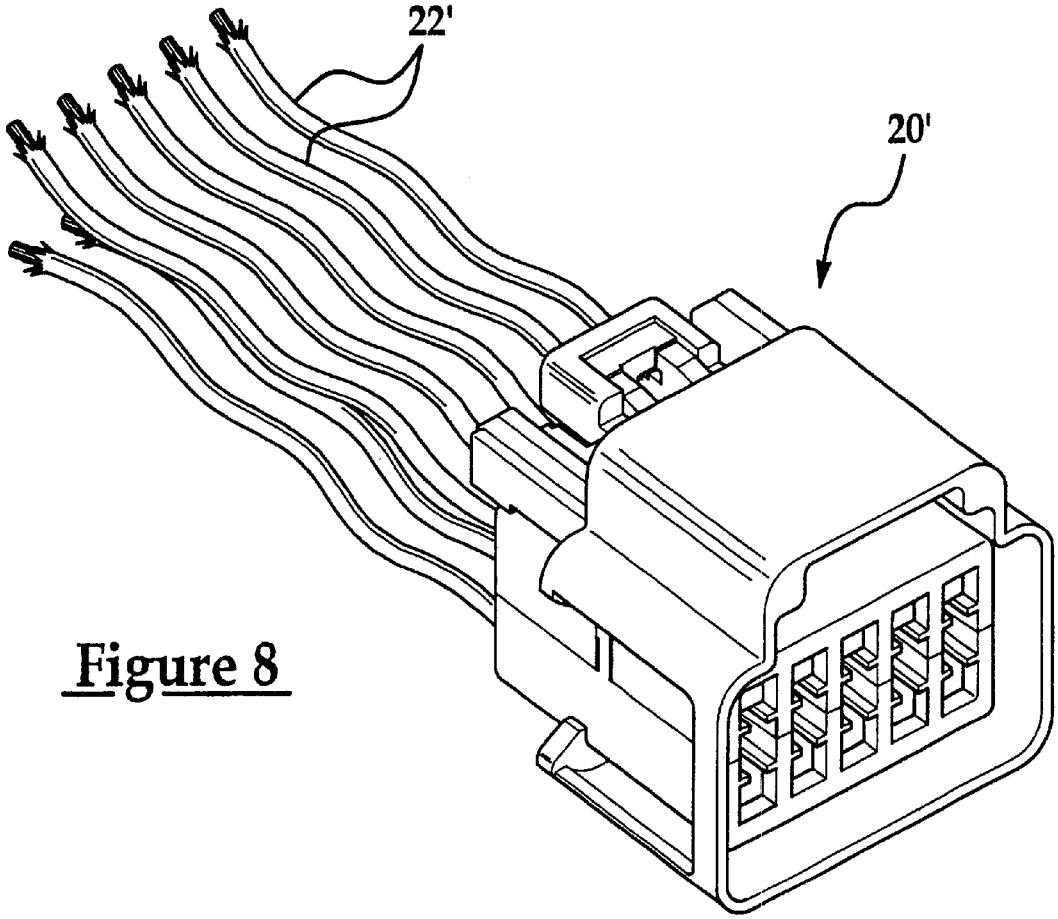
FIG. 8 is a perspective view of a second embodiment of the electrical connector.

Referring to FIG. 8, a second embodiment of the electrical connector 20' is shown wherein the flex circuit 22 of the first embodiment is replaced with a plurality of individually electrically insulated conductors 22'. Electrical connector 20' is otherwise identical to connector 20.

Although the preferred embodiments of the present invention are disclosed various changes and modifications may be made thereto by one skilled in the art without departing from the scope and spirit of the invention as set forth in the appended claims. Furthermore it is understood that the terms used herein are merely descriptive rather than limiting and various changes may be made without departing from the scope and spirit of the invention.

What is claimed is:

1. An electrical connector comprising:

an elongated first carrier having an inner face;

an elongated second carrier having an inner face which faces and contacts the inner face of the first carrier;

a first terminal engaged to the inner face of the first carrier;

a second terminal accessible from the inner face of the second carrier; and a shroud having a forward annular portion engaged unitarily to a rearward clip portion, the clip portion having a side clearance, wherein the first and second carriers are snap fitted into the clip portion through the side clearance from a lateral direction.

2. The electrical connector as set forth in claim 1 further comprising:

an elongated ledge extended laterally within the shroud and projecting radially inwardly from the shroud; and the first carrier having an outer face disposed opposite the inner face, the outer face defining a laterally extending slot which receives the respective ledge as the first and second carriers are side mounted into the clip portion of the shroud.

3. The electrical connector as set forth in claim 2 wherein the first carrier has a first weld access port extending laterally through the first carrier exposing the first terminal, and wherein the second carrier has a second weld access port extending laterally through the second carrier exposing the second terminal.

4. An electrical connector comprising:

an elongated first carrier having an inner face;

an elongated second carrier having an inner face which faces the inner face of the first carrier;

a first terminal engaged to the inner face of the first carrier;

a second terminal engaged to the inner face of the second carrier;

a shroud having a forward annular portion engaged unitarily to a rearward clip portion, the clip portion having a side clearance, wherein the first and second carriers are snap fitted into the clip portion through the side clearance from a lateral direction;

an elongated ledge extended laterally within the shroud and projecting radially inwardly from the shroud;

the first carrier having an outer face disposed opposite the inner face, the outer face defining a laterally extending slot which receives the respective ledge as the first and second carriers are side mounted into the clip portion of the shroud;

wherein the first carrier has a first weld access port extending laterally through the first carrier exposing the first terminal, and wherein the second carrier has a second weld access port extending laterally through the second carrier exposing the second terminal;

a retaining clip engaged to the first carrier, disposed between the first and second carriers and projecting rearward from the shroud, wherein the clip is constructed and arranged to assure the position of the first and second terminals within the first and second carriers, the clip having an aperture; and the first carrier having a projection snap fitted into the aperture.

5. The electrical connector as set forth in claim 4 wherein the elongated ledge has an end prong disposed near the side clearance and extended rigidly inwardly from the ledge and wherein the first carrier snap fits past the end prong as the first and second carriers are side mounted into the clip portion of the shroud.

6. The electrical connector as set forth in claim 5 further comprising a flex circuit having a first bank having a first conductor engaged electrically to the first terminal and a second bank having a second conductor engaged electrically to the second terminal.

7. The electrical connector as set forth in claim 6 wherein the clip has a leading upper return bend and a leading lower return bend each having a wing extending rearward, the wing of the upper return bend having the aperture, the wing of the lower return bend having another aperture which engages another projection of the second carrier.

8. The electrical connector as set forth in claim 7 wherein the clip has a tab extending rearward from and between the upper and lower return bend portions and between the first and second banks of the flex circuit.

9. The electrical connector as set forth in claim 8 further comprising:

the first and second carriers being identical;

the shroud having a second elongated ledge in opposition to the first elongated ledge, the second elongated ledge residing within a laterally extending slot defined by an outer face of the second carrier;

the retaining clip engaged to the second carrier, the retaining clip having a second aperture; and the second carrier having a projection snap fitted into the second aperture.

10. The electrical connector as set forth in claim 9 wherein the first and second carriers each have a groove defined by the respective inner faces, each groove extending longitudinally through a forward face of each first and second carrier, the first and second terminals engaged within the respective groove, and the forward faces exposed through a forward opening defined by the annular portion of the shroud.

11. The electrical connector as set forth in claim 10 wherein the upper and lower return bends of the clip each have a tang extended forward within the respective groove of the first and second carriers, the tangs being engaged to the respective first and second terminals.

12. The electrical connector as set forth in claim 11 wherein the first and second carriers each have a post projecting outward from the inner face and a hole defined by the inner face, the post of the first carrier being disposed in the hole of the second carrier and the post of the second carrier being disposed in the hole of the first carrier.

13. An electrical connector comprising:

a plurality of conductors;

a plurality of terminals, each one of the plurality of terminals engaged to a respective one of the plurality of conductors;

a first carrier having an inner face, a groove, and a forward face, the inner face defining the groove which extends forward through the forward face;

a second carrier having an inner face, a groove, and a forward face, the inner face defining the groove which extends forward through the forward face, the inner face of the first carrier engaged to the inner face of the second carrier, wherein each one of the plurality of terminals are disposed within a respective one of the grooves of the first and second carriers, the plurality of terminals being exposed through the forward faces of the respective first and second carriers;

the first and second carriers each having a cantilevered flex arm disposed within the respective grooves and engaged to the respective terminals of the first and second carriers, the flex arm of the first carrier engaged to the flex arm of the second carrier along an imaginary plane of the inner faces; and a shroud having a rearward clip portion and a forward annular portion defining a forward opening, the forward faces of the first and second carriers exposed through the forward opening, the clip portion having a side clearance, wherein the first and second carriers are snap fitted into the clip portion through the side clearance from a lateral direction.

14. The electrical connector as set forth in claim 13 further comprising:

the clip portion of the shroud having an elongated ledge extended laterally from the gap and projecting inwardly from the shroud; and the first and second terminal carriers each having an outer face disposed opposite the inner faces, each outer face defining a laterally extending slot which receives the respective ledge as the first and second terminal carriers are side mounted into the clip portion.

15. An electrical connector comprising:

an elongated first carrier having an inner face;

an elongated second carrier having an inner face which faces the inner face of the first carrier;

a first terminal engaged to the inner face of the first carrier;

a second terminal engaged to the inner face of the second carrier;

a shroud having a forward annular portion engaged unitarily to a rearward clip portion, the clip portion having a side clearance, wherein the first and second carriers are snap fitted into the clip portion through the side clearance from a lateral direction; and a flex circuit having a first bank having a first conductor engaged electrically to the first terminal and a second bank having a second conductor engaged electrically to the second terminal.

* * * * *